United States Patent [19]

D'Arcy

[11] 4,121,361

[45] Oct. 24, 1978

[54] APPARATUS FOR AUTOMATICALLY TURNING PAGES

[76] Inventor: James A. D'Arcy, 2008 Donna Dr., Laguna Beach, Calif. 92651

[21] Appl. No.: 757,958

[22] Filed: Jan. 10, 1977

Related U.S. Application Data

[63] Continuation-in-part of Ser. No. 669,821, Mar. 24, 1976, abandoned.

[51] Int. Cl.[2] ..... G09F 7/00

[52] U.S. Cl. ..... 40/470; 40/531

[58] Field of Search ..... 40/104, 104 A, 350; 84/487

[56] References Cited

U.S. PATENT DOCUMENTS

| | | | |
|---|---|---|---|
| 2,755,580 | 7/1956 | Justice | 84/487 |
| 2,791,847 | 5/1957 | Hagman | 40/104 R |
| 2,885,806 | 5/1959 | Storm et al. | 40/104 R |
| 4,031,644 | 1/1957 | Rodgers | 84/487 X |

FOREIGN PATENT DOCUMENTS

| | | | |
|---|---|---|---|
| 1,076,511 | 7/1967 | United Kingdom | 40/104 A |

*Primary Examiner*—Louis G. Mancene
*Assistant Examiner*—Wenceslao J. Contreras
*Attorney, Agent, or Firm*—William W. Haefliger

[57] ABSTRACT

Apparatus for sequentially turning stacked pages includes several actuator driven elements. These include a pusher to frictionally push an exposed page in a turn direction and resulting in upward bulging of the page; a foot to clamp a page to be turned to facilitate development of the bulge; at least one flipper arm to swing under the bulge and flip the page over; and a turned page holder that temporarily lifts to allow a turning page to be received on a stack of turned pages, for subsequent clamping by the holder. The actuator includes a linearly moveable member that is motor driven and that actuates the elements. Also provided are a holder for pages to be turned; a string to hold down groups of turned pages, and a receptacle for a book (as for example a paper back book), the receptacle being capable of inversion to allow a bed-ridden reader to use the apparatus with no effort spent in turning pages.

27 Claims, 16 Drawing Figures

APPARATUS FOR AUTOMATICALLY TURNING PAGES

BACKGROUND OF THE INVENTION

This application is a continuation-in-part of my prior application Ser. No. 669,821, filed Mar. 24, 1976 and entitled "Automatic Page Turning Apparatus" now abandoned.

This invention relates generally to apparatus for automatically turning pages of a book or the like; more particularly it concerns simple, compact, reliable apparatus which requires only minimal effort of a user or reader to effect the page turning operation.

There is need for devices of the type described herein, allowing persons who are partially immobilized, disabled or bedridden to turn pages of a book, at will, merely by operation of a switch. Prior devices either did not have this capability or they were bulky, heavy, or insufficiently reliable particularly when inverted to cause the book to face downwardly toward a bedridden patient. Examples of prior devices are found in U.S. Pat. Nos. 2,638,701; 1,692,337; 2,359,895; 2,677,510; 2,317,001; and 3,343,776. Such prior devices were not constructed for turning pages of so-called "paper back books" whose rough textured pages are especially difficult to handle, mechanically.

SUMMARY OF THE INVENTION

It is a major object of the invention to provide reliable, lightweight, compact and efficient apparatus for turning pages of a book or the like, the apparatus being automatic and characterized as overcoming problems associated with prior devices.

It is another object of the invention to provide automatic page turning apparatus which may be inverted to face downwardly, without disruption of its functioning.

It is a further object of the invention to provide apparatus capable of efficiently and automatically turning pages of a paper backed book.

Additional objects of the invention include the provision of an actuator driven rotor bodily movable in a page turning direction while yieldably urged against the page to frictionally push the page into an upward bulging configuration facilitating turning by a flipper arm; the provision of a foot displaceable by the actuator from a down position, in which the foot engages the page to be turned to facilitate development of the upward bulge, to an up position in which the foot allows upward turning of the page past the foot; the provision of an elongated member reciprocable by a gearmotor or the like to develop motion for actuating the rotor and foot as described; the provision of a first flipper arm actuated by the gearmotor to swing under the upward bulge of the page to be turned and to flip the page over toward turned position; the provision of a second flipper arm at the opposite side of the book, to be actuated in conjunction with the first flipper arm to aid in turning the page; the provision of a turned page holder operatively connected with the actuator driven means for cyclic displacement between up and down positions, allowing seating of a turning page on a stack of turned pages, and subsequent clamping of that page on the stack, by the holder. A holder at the opposite end of the book yieldably holds pages to be turned in stack-clamped condition, whereby the operation of both holders facilitates inversion of the apparatus to face the book downwardly, without dislocation. An adjustable string passing between groups of pages further facilitates these objectives.

These and other objects and advantages of the invention, as well as the details of an illustrative embodiment, will be more fully understood from the following description and drawings, in which:

DRAWING DESCRIPTION

GENERAL ORGANIZATION

Figure 1:
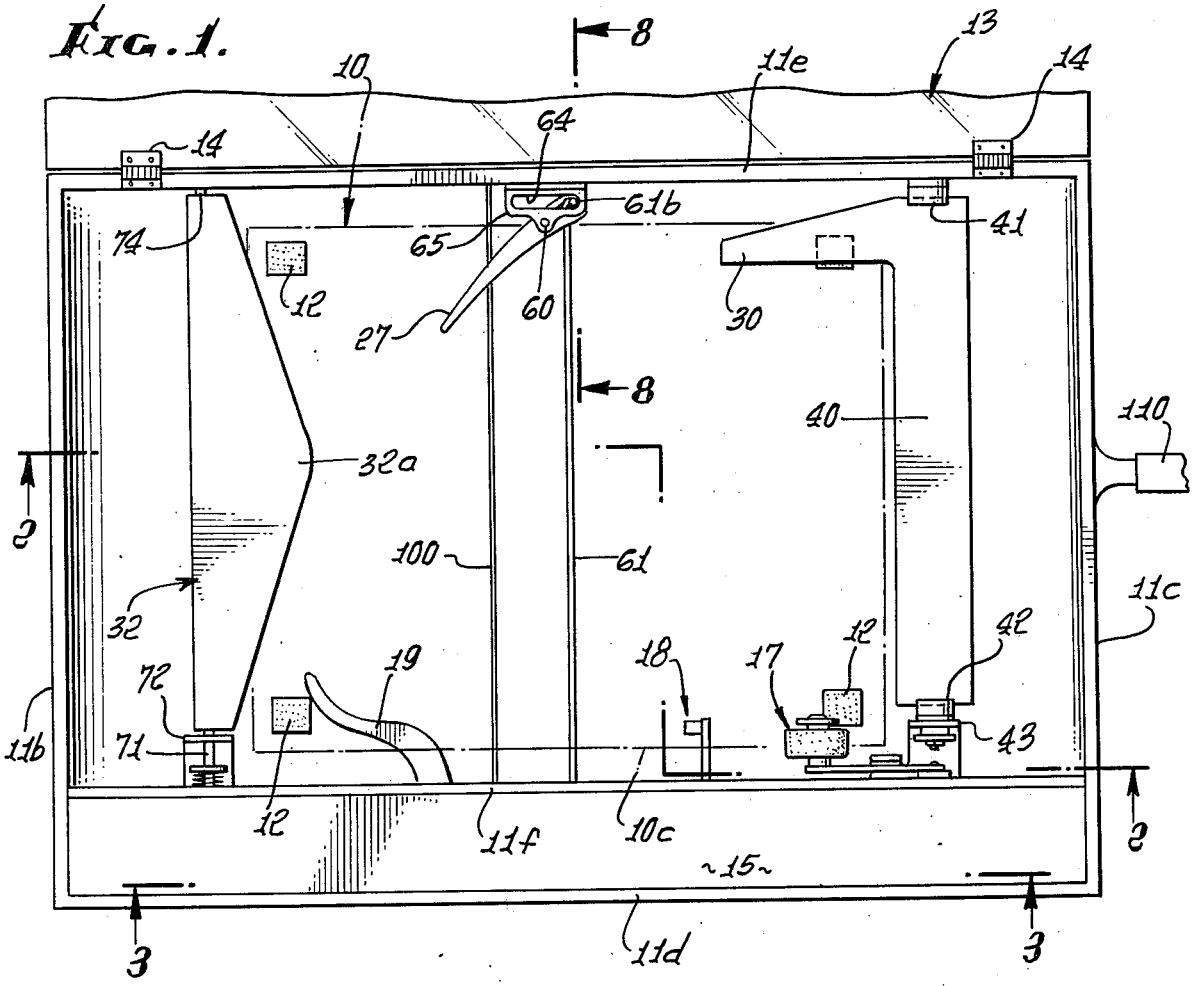
FIG. 1 is a top plan view of apparatus embodying the invention.
Figure 2:
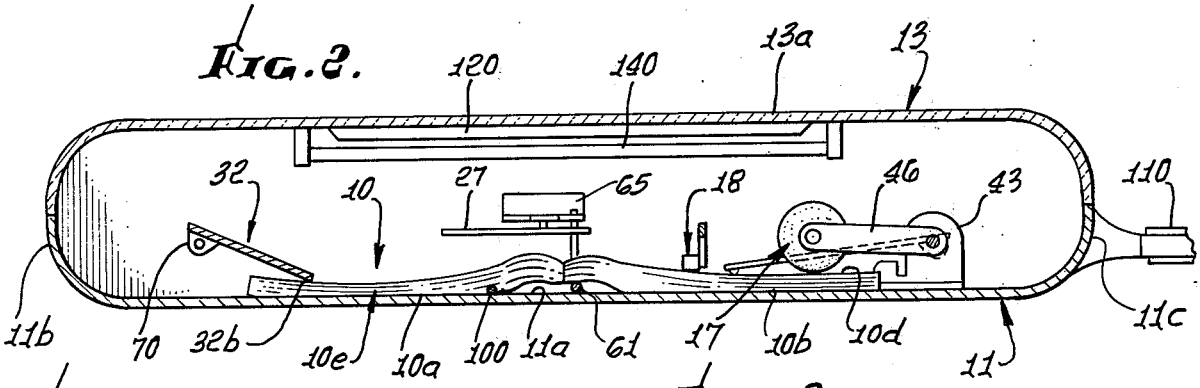
FIG. 2 is a section taken on elevation on lines 2—2 of FIG. 1.

In the drawings, structure is shown forming a zone to receive pages of a book or the like. As an example, a paper-back book 10 is shown in FIG. 2 in open condition, with its front and back covers **10*a* and 10*b* laid flatly against the bottom wall 11*a* of the receptacle 11. That wall may have adhesive strips 12 presented upwardly as seen in FIG. 1 to engage and adhesively retain the covers to thereby position the book, the outer rectangular boundary of which is indicated by broken lines 10*c* in FIG. 1. The receptacle 11 also includes end walls 11*b* and 11*c*, and side walls 11*d* and 11*e*. A cover 13 for the receptacle may be hinge connected thereto as at 14, and may have a glass or clear plastic transparent top wall 13*a* allowing viewing through same. A light may also be provided to illuminate the interior of the receptacle. Such a light, at 140**, may be suitably supported.

Figure 16:
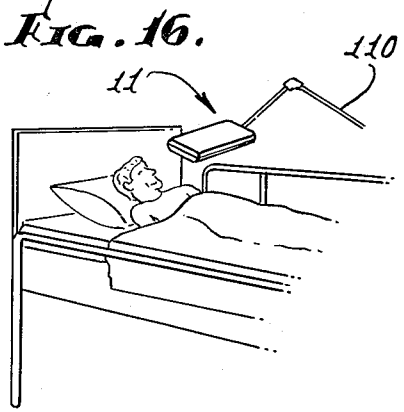
FIG. 16 is a view of the mechanism as related to a reader who is lying on his back.
Figure 12:
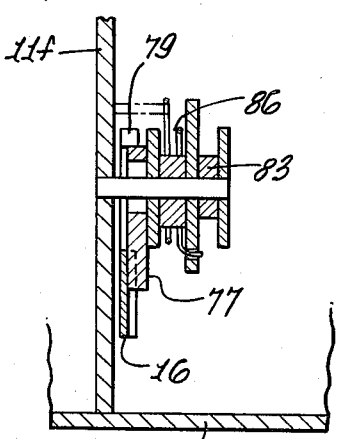
FIG. 12 is a section taken in elevation on lines 12—12 of FIG. 9.

A longitudinal upright partition **11*f* extends within the receptacle to separate the book zone from a longitudinally elongated actuator zone 15. The receptacle may be supported by an arm 110, so as to be controllably and adjustably oriented relative to a reader. For example, the reader may be lying on his back, as on a hospital bed, and the receptacle may be fully or partially inverted, so that the open pages of the book 10 face downwardly toward the reader. As wll appear, the book is not dislocated during such inversions. See FIG. 16**.

Figure 4:
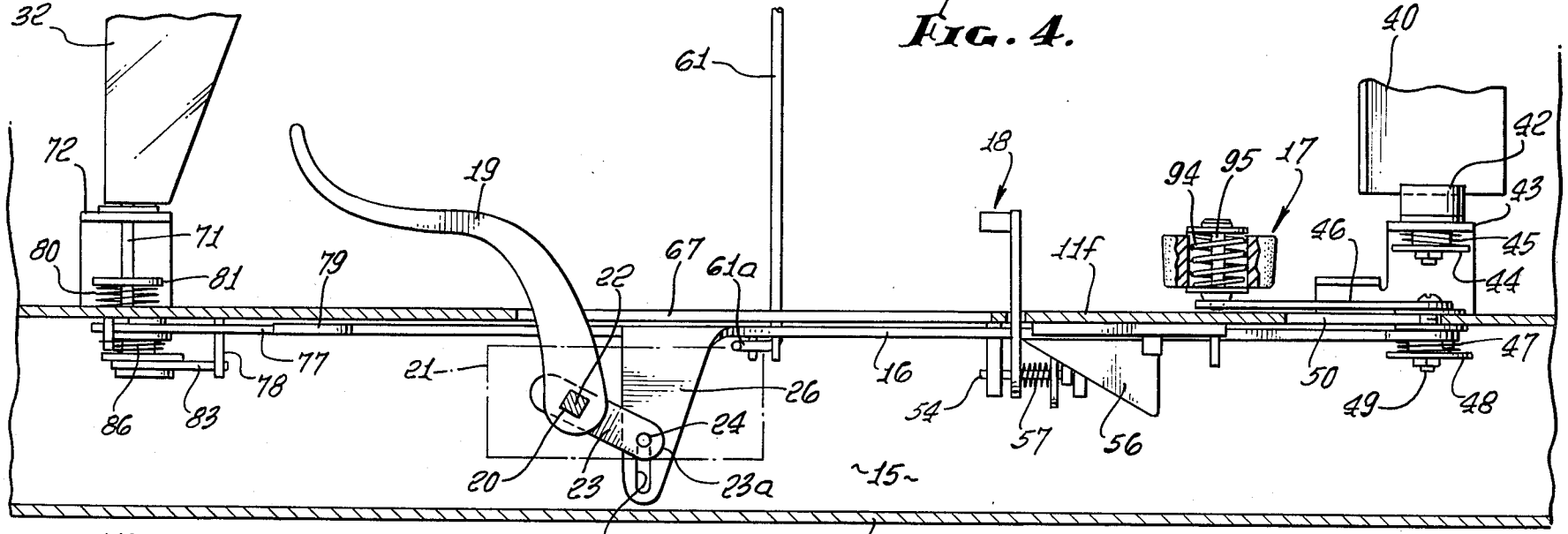
FIG. 4 is a top plane view taken on lines 4—4 of FIG. 3.
Figure 3:
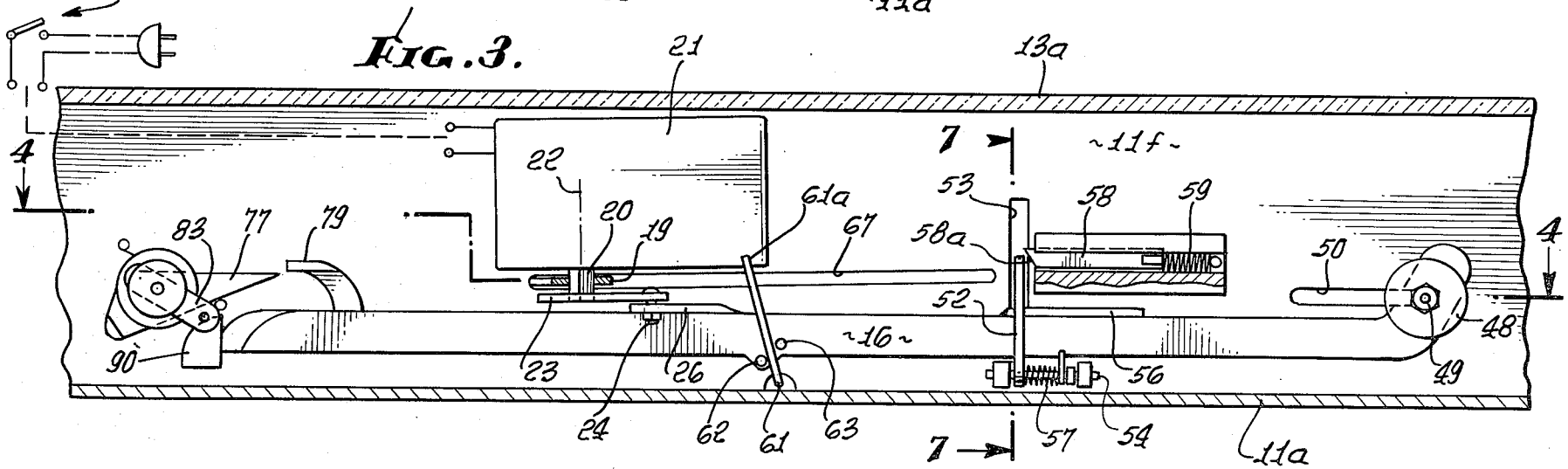
FIG. 3 is an enlarged elevation taken on lines 3—3 of FIG. 1.

Actuator driven means is typically carried by the receptacle structure, as for example within the narrow side zone or compartment 15, in order to provide a compact assembly. Such means may with unusual advantage include a longitudinally elongated member 16, as seen in FIGS. 3 and 4. That member is movable or reciprocable longitudinally endwise, so that components operatively connected to that member are movable to effect page turning.

Extending the description to FIGS. 13–15 a pusher, or rotor in the form of a roller, is indicated at 17 and is operatively connected to the actuator driven means to frictionally push an exposed page 10*d* in a turn direction (to the left in FIGS. 1, 2 and 13–15) and slidably over the next below page, and resulting in upward bulging of that upper page as indicated at 10*d*'. Such motion of the pusher occurs in response to leftward displacement of the member 16. The page is pushed out from beneath a retainer arm 30 yieldably urged downwardly against the page.

A clamping foot indicated at 18 is located to clamp down on page 10*d* leftwardly of the roller to facilitate initial development of the bulge. This is important particularly in the case of a "paper back" book, whose pages frictionally resist relative sliding. The foot is also operatively connected to the actuator driven means, as for example to member 16, to lift and thereby release that page for continued upward bulging indiciated at 10*d*'' and turning in response to left displacement of member 16, as seen in FIG. 14.

Figure 6:
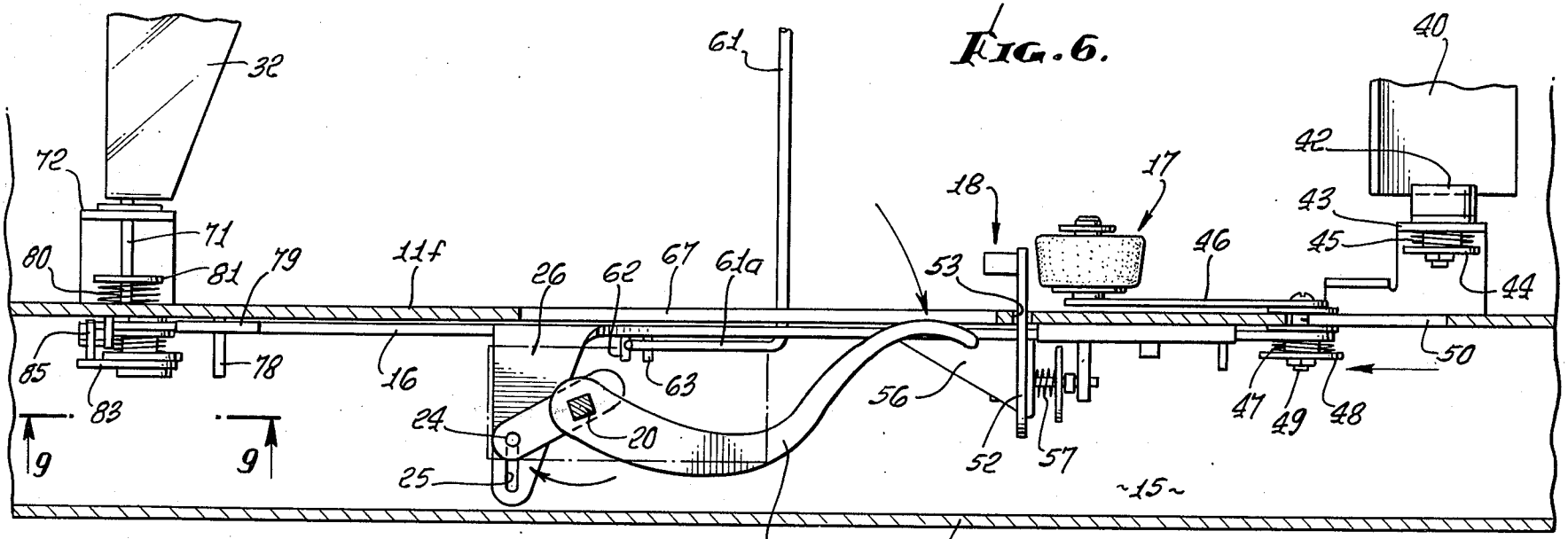
FIG. 6 is a view like FIG. 4, but showing a shifted position of the mechanism.
Figure 5:
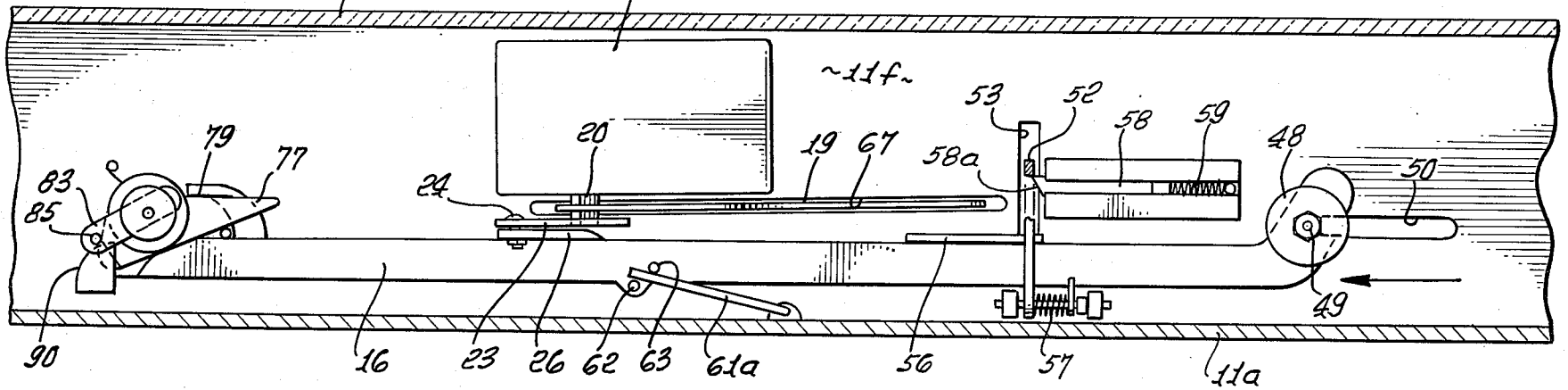
FIG. 5 is a view like FIG. 3, but showing a shifted position of the mechanism.

A first flipper arm 19 spaced leftwardly of the foot is also operatively connected to the actuator driven means, as for example to the output shaft 20 of a gearmotor (indicated at 21 in FIG. 5). The arm 19 is swingable about the upright axis 22 of shaft 20 and in a counterclockwise direction in FIG. 14 to move beneath the extreme upward bulge 10*d*'' and to flip the page over (to the left) toward the stack 10*e* of already turned pages. Arm 19 is at an elevation to ride over the turned page, as seen in FIG. 15. This occurs during rightward displacement of the member 16. Leftward movement of the member 16 swings the arm to retracted position as seen in FIG. 6. FIG. 15 shows the arm 19 as located during the rightward "at rest" position of member 16. FIGS. 4 and 6 illustrate the coupling of the shaft 20 to member 16. Link or crank 23 is also rigidly mounted on that shaft and its outward end 23*a* carries a stud 24 that works in a lateral slot 25 formed in a tongue 26 integral with member 16, as the shaft rotates. The shaft is rotatably reciprocated and displaces member 16 longitudinally endwise to an extent determined by shoulders at the end of slot 25.

A second flipper arm 27 is also operatively connected to the actuator driven means to move under the bulge and to assist in flipping the page over toward already turned pages, in response to rightward displacement of member 16. In this regard, and as shown in FIG. 14, arm 19 rotates counterclockwise about vertical axis 22, and arm 27 rotates clockwise about its vertical axis 28, during page turning. Subsequently they are returned to FIG. 13 position as the member 16 moves rightwardly.

Finally, a turned page holder 32 is operatively coupled to the actuator driven means to hold down turned pages as during initial displacement of the member 16 to the left. It temporarily moves out (up in FIG. 15) of the path of a page being turned to allow completion of such turning, after which the holder moves back down to clamp the turned page, all in response to reciprocation of the member 16. In practice, the page may be allowed to momentarily contact the top of the holder, after which the latter moves to allow completion of page turning.

DETAILED DESCRIPTION

Referring to FIGS. 1–6, the retainer arm 30 is integral with and projects leftwardly from a laterally elongated retainer body 40 pivoted for rotation at trunnions 41 and 42. Trunnion 41 turns in a bearing in wall 11*e*, while trunnion 42 turns in a bearing in a bracket 43. A disc 44 turns with the trunnion, and a torsion spring 45 retained between the disc and bracket urges the disc and body 40 in a rotary direction urging arm 30 downward.

The pusher roller 17 is shown as carried on an arm 46 urged counterclockwise (in FIG. 2) by a torsion spring 47 (FIG. 4). That spring is retained between a disc 48 integral with a lateral pin 49 attached to the arm and projecting through an elongated slot 50 in wall 11*f*, and also through an opening in member 16. Therefore, as the member 16 is urged to the left in FIGS. 3 and 4 by gearmotor 21, the pusher roller is carried with it, and the frictional surface of the roller frictionally pushes the top page of the stack to the left, and toward the foot 18, resulting in creation of the bulge as described. The roller is constructed to have a one-way clutch allowing one-way rotation only, i.e. to rotate clockwise in FIG. 2 (but not counterclockwise, so that it does not rotate during shifting to the left to create the bulge; however, on the return stroke of member 16 to the right, the roller rotates over the top of the next exposed page. Alternatively, the roller may be driven in place to rotate and frictionally displace the page as described, and subsequently to rotate in the opposite direction to hold the next page stretched out. The roller is broken away in FIG. 4 to show an internal torsion spring 94 connected to the shaft 95 that carries the roller and engaging the roller bore, to provide for one-way rotation.

Figure 7:
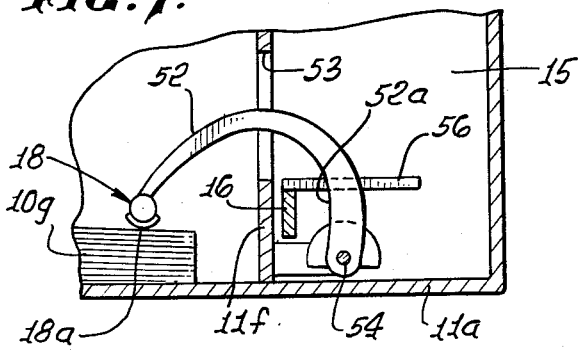
FIG. 7 is a fragmentary elevation taken on lines 7—7 of FIG. 3.

Extending the description to FIG. 7, the foot 18 is shown as carried at one end of an arcuate carrier arm 52 projecting through an opening 53 in wall 11*f*. The opposite end of the arm is pivoted at 54 in zone 15 to allow the foot to move up and down, in a lateral vertical plane. The surface of the foot may carry a friction material at 18*a*, to frictionally retain the top page in position beneath the foot during page bulge development. As the member 16 is advanced to the left between positions seen in FIGS. 4 and 6, a lateral horizontal cam 56 carried by that member engages the arm to pivot same upwardly and the bulged page to pass leftwardly beneath the raised foot. A torsion spring 57 (seen in FIG. 5) yieldably biases the arm counterclockwise in FIG. 7, to hold the foot 18 and 18*a* down on the stack 10*g* of pages to be turned. A latch 58, urged leftwardly in FIG. 3 by spring 59, engages the top of the arm 52, to positively hold the arm down until released by upward force transmitted to the underside of the arm at 52*a* by cam 56. The latter is tapered leftwardly and laterally as shown. The edge 58*a* of the latch is also tapered to be urged to the right by the arm. Note the lifting of arm 52 is delayed (i.e. cam 56 is initially spaced from the arm) until the roller 17 has shifted leftwardly to develop the bulge 10*d*' seen in FIG. 13.

The first flipper arm 19 is coupled to the actuator driven means, as for example the polygonal cross section output shaft 20 of the gearmotor 21, so as to be rotated to FIG. 6 position as member 16 moves leftwardly. In that position, the arm 19 is outside the path of upward turn-over of the page 10*d*; however, on the subsequent return stroke of member 16 to the right, the arm 19 swings counterclockwise, flipping the turning page 10*d* down toward the stack 10*e*. See the sequence illustrated in FIGS. 13–15. The foot 18 is also dropped onto the next page 10*dd* to be turned, as the member 16 strokes to the right. Arm 19 projects through a slot 67 in partition 11*f*.

A usable gearmotor is produced by Orbit Electronics, Los Angeles, California, and is identified by the name SERVOMECHANIC. A switch to control operation of the motor (to cycle part 16 once) is indicated at 110 in FIG. 3.

Figure 8:
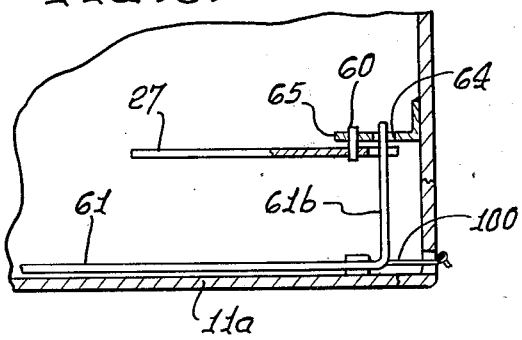
FIG. 8 is a fragmentary elevation taken on lines 8—8 of FIG. 1.
Figure 13:
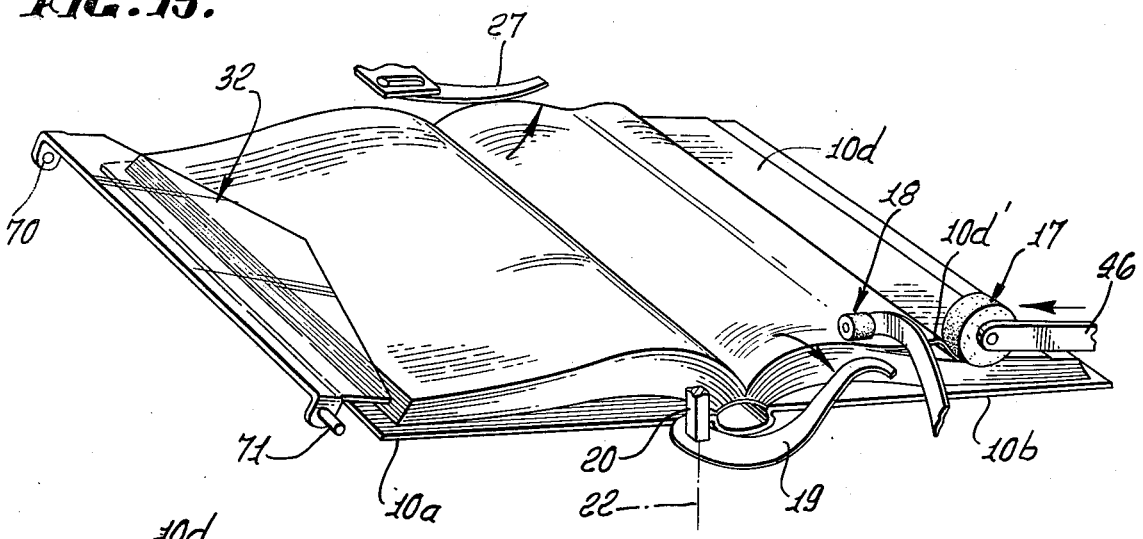
FIG. 13 is a perspective showing of the apparatus of the invention in combination with a book, and at the initiation of page turning.
Figure 14:
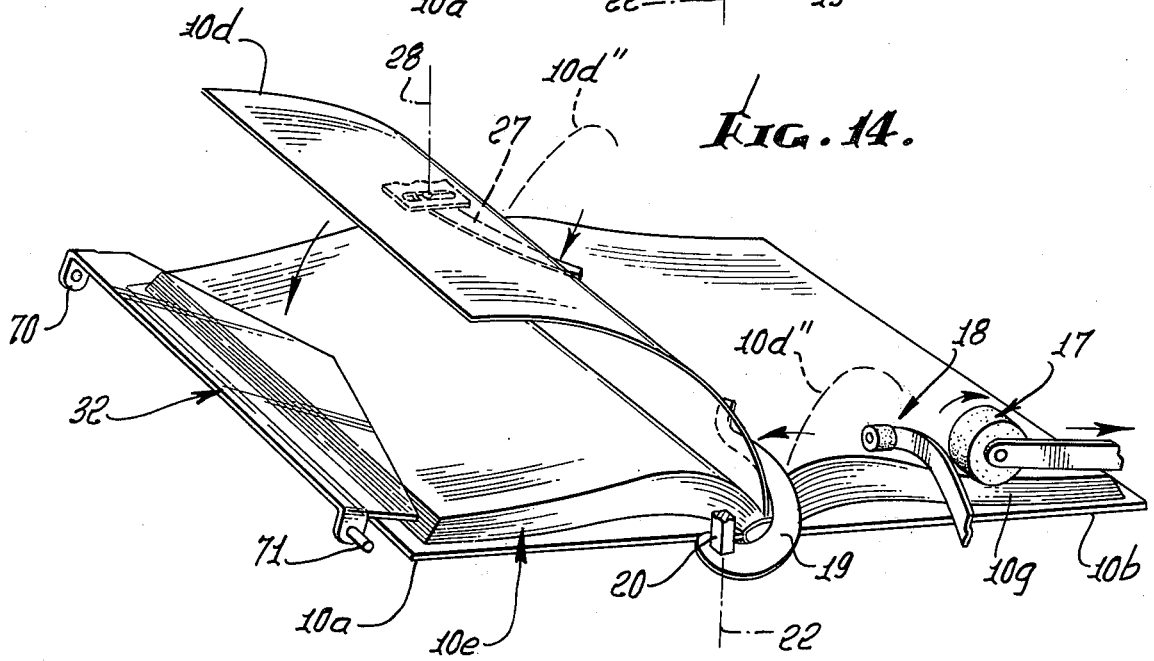
FIG. 14 is a view like FIG. 13 but showing an intermediate position of the mechanism during page turning.
Figure 15:
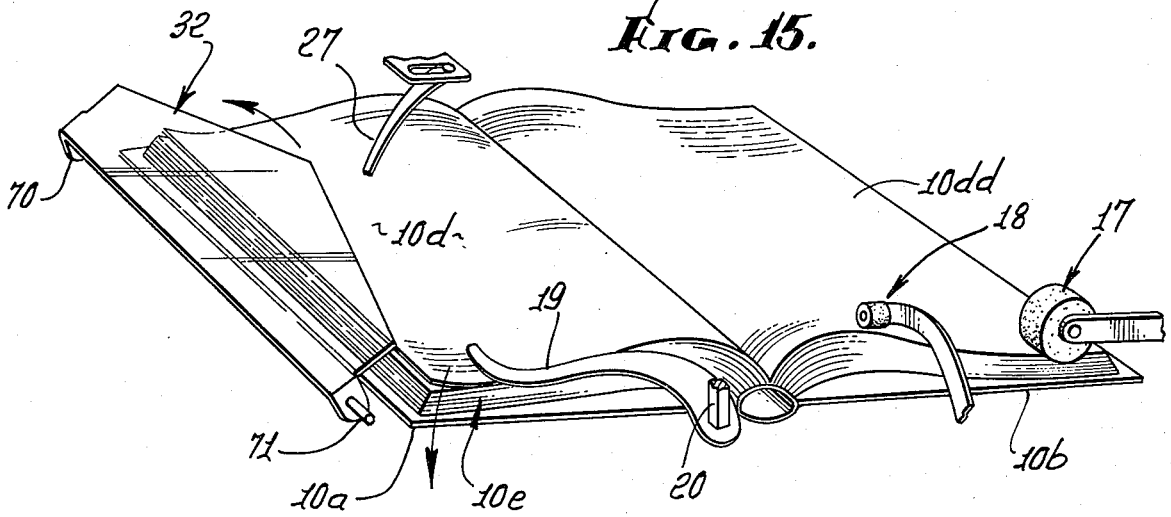
FIG. 15 is a view like FIG. 13 showing a position of the mechanism near completion of page turning.

As seen in FIG. 8, the second arm 27 is pivoted at vertical hinge or pivot 60 to swing in a horizontal plane, between positions shown in FIGS. 13–15. The coupling between the member 16 and the arm 27 includes a link 61 located to extend laterally beneath the book (see FIG. 2). One end of the link is turned upwardly at 61*a* in FIG. 3 to be slidably contained between pins 62 and 63 on member 16, so that as the latter reciprocates the link 61 is rotated about its length axis. The opposite end of the link is turned up at 61*b* (see FIG. 8) to engage the end of arm 27 projecting opposite the pivot 60 from the main extent of the arm. A longitudinal guide slot 64 in a bracket 65 also guidably receives turned end 61*b*, as seen in FIG. 1. Arm 27 pivots counterclockwise in FIG. 13 to clear the top of the book as the member 16 moves to the left; and, arm 27 pivots clockwise in FIGS. 14 and 15 to aid in turning the page 10*d* as member 16 moves to the right.

Figure 11:
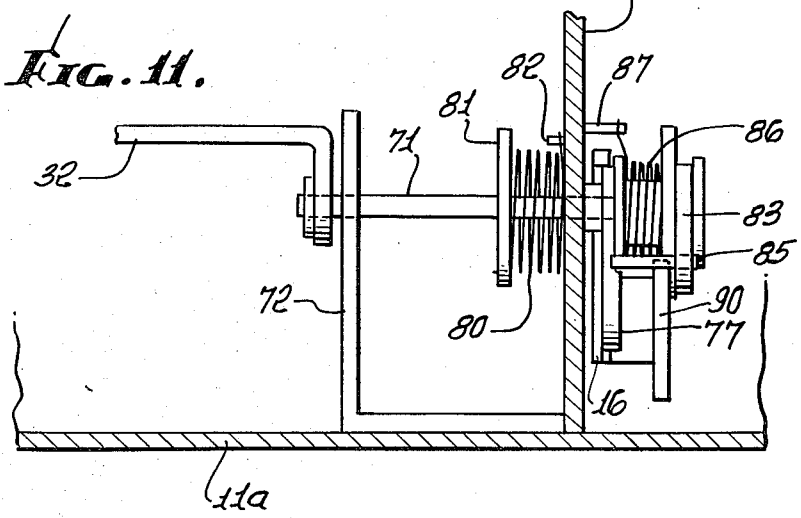
FIG. 11 is an end view taken on lines 11—11 of FIG. 9.

The turned page holder 32 shown in the drawings is laterally elongated and has end bearings as exemplified by socket 70 and pin 71. The latter projects through bracket arm 72 and partition 11*f*, as seen in FIG. 11, to connect with a coupling that operatively couples the member 16 to the holder 32. Socket 70 receives a suitable pin 74 projecting from wall 11*e*. Note the center portion 32*a* of the holder 32 that tapers in a rightward direction in FIGS. 1 and 2 over the edge portion of a turned page, to engage same at 32*b*.

Figure 10:
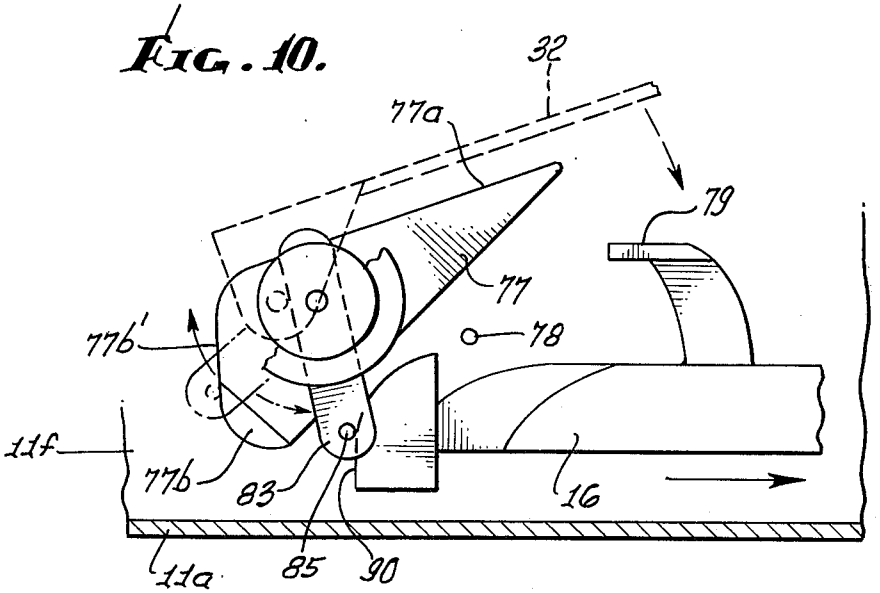
FIG. 10 is a view like FIG. 9, but showing a shifted position of the mechanism.
Figure 9:
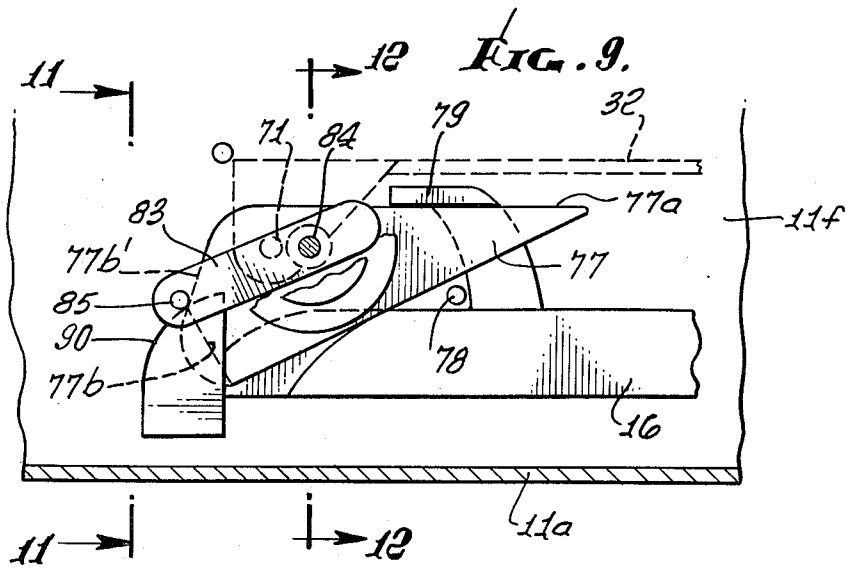
FIG. 9 is an enlarged fragmentary side elevation taken on lines 9—9 of FIG. 6.

The coupling includes a rocking latch part 77 having a frictional slip fit with pin 71, and which rocks between down position as seen in FIG. 9 (wherein a shoulder 78 stops the part) and an up position as seen in FIG. 10, in correspondence with rocking of the holder. Holder 32 may have a range of "down" positions in FIG. 9 as accommodated by the described slip fit. In FIG. 9, a keeper 79 on the member 16 moves closely over the part 77 to keep it in down position as the member 16 reciprocates at the left end of its stroke. A torsion spring 80 with ends connected to a disc 81 on shaft 71 and to a pin 82 on wall 11*f* yieldably urges the part 77 toward down position, as described (clockwise in FIG. 9).

A link 83, pivotally supported by pin 84 in eccentric or offset relation to pivot pin 71, rotates independently of part 77, and between positions as seen in FIGS. 9 and 10. Link 83 has releasable coupling to part 77, as via a follower pin 85 and a cam surface 77*b* on part 77. A torsion spring 86 coupled to post 87 on wall 11*f* and to the link 83 urges the link counterclockwise in FIG. 9. An operative connection between the link and member 16 includes a coupling surface on the link (provided by pin 85) engageable with a coupling surface 90 on the member 16.

In operation, as the member 16 moves to the right (beyond the position shown in FIG. 10) and toward retracted position, the link 83 remains decoupled from the part 77, (i.e. pin 85 clears the relief at 77*b*) so that the torsion spring 80 urges holder 32 downward toward engagement with the turned page. As member 16 subsequently cycles to the left during turning of the next page, surface 90 engages pin 85 to displace the link clockwise to FIG. 9 position, torsion spring 86 is further energized, and pin 85 passes through the relief 77*b* on part 77. Also keeper 79 slides over the top 77*a* of part 77. Thereafter, as member 16 moves to the right, the link 83 rotates clockwise under the influence of spring 86, the latter overcomes spring 80, pin 85 frictionally engages surface 77*b*′ on part 77, and both link 83 and part 77 rotate counterclockwise to FIG. 10 position after keeper 79 clears surface 77*a*. Thereafter, the pin 85 slides off surface 77*b*′ and past relief 77*b* on part 77 to decouple part 77 from link 83, and the torsion spring 80 yieldably urges the part 77 and holder 32 to down position.

Finally, a hold-down band or string 100 is carried by the structure (see FIGS. 1 and 2) to extend laterally between groups of already turned pages to hold the lowermost group in down position. As a result, when the apparatus is inverted as in FIG. 16, the weight of the held-down group of pages is not transmitted to the holder 32. String 100 may be yieldably resiliently stretchable, allowing it to be shifted into different interleaved positions.

A magnifying device such as a lens 120 may be attached to the transparent cover 13, to aid in viewing writing on the pages.

I claim:

1. In apparatus for sequentially turning stacked pages of a book or the like, the combination comprising
   (a) structure forming a zone to receive said pages,
   (b) a pusher located proximate said zone to engage an exposed page to be turned,
   (c) an electrical actuator and actuator driven means operatively connected with the pusher for bodily displacing same generally linearly and with back and forth reciprocation in the direction of page turning between a first position and a range of subsequent advanced positions, said first position characterized in that the pusher is urged against the exposed page to be turned, and said range of subsequent positions characterized in that the pusher is bodily displaced to frictionally push the exposed page in a turn direction causing its sliding against another page and resulting in progressive upward bulging of that page while sliding over the surface of the next below page beneath the pusher,
   (d) and a retainer arm yieldably urged against the exposed page to be turned.

2. The combination of claim 1 wherein the pusher comprises a rotor, and including a one-way clutch associated with the rotor to block rotor-rotation as the rotor is bodily displaced in said direction, and accommodating rotor rotation as the rotor is returned to its initial position by the actuator, and structure yieldably urging the rotor toward the exposed page to be turned.

3. The combination of claim 1 including said stack of pages, and means to hold said stack of pages in said zone.

4. In apparatus for sequentially turning stacked pages of a book or the like, the combination comprising
   (a) structure forming a zone to receive said pages, (b) a clamping foot located proximate said zone to engage an exposed page to be turned, (c) and actuator driven means operatively connected with the foot for displacing same between a down position and a raised position, said down position characterized in that the foot is maintained in clamping engagement with a localized medial zone of the page as a free end portion of the page is urged in a turn direction, whereby said free end portion progressively bulges upwardly, said raised position characterized in that foot is temporarily raised to free the bulged page to be bodily displaced relatively under the raised foot and in said turn direction.

5. The apparatus of claim 4 wherein the actuator driven means includes a member linearly reciprocable in said page turning direction and in a return direction, and including the actuator in the form of an electrically energized motor coupled to said member.

6. The combination of claim 5 including said stack of pages in said zone, said member located proximate page edges.

7. The combination of claim 5 including a carrier carrying the foot on said structure for pivotal movement between said down and raised position, yieldable means biasing the carrier to urge the foot toward said down position, and said actuator driven means including a cam operatively engageable with said carrier to urge the foot toward said raised position in response to movement of said member in said page turning direction.

8. In apparatus for sequentially turning stacked pages of a book or the like, the combination comprising (a) structure forming a zone to receive said pages, (b) a first flipper arm proximate said zone to engage an exposed page to be turned, (c) an electrical actuator and actuator driven means operatively connected with the arm for bodily displacing same along a generally linear path and with back and forth reciprocation between retracted and advanced positions, said advanced position characterized in that the arm is temporarily maintained overlying an already turned page, said arm being retracted while a page to be turned is urged in a turn direction and progressively bulged upwardly, said path of arm displacement between retracted and advanced positions characterized in that the arm is brought under said bulge and into engagement with the page to be turned and said arm then flips said page over and beneath the arm as the arm reciprocates to move in a direction opposite to page turning, and toward retracted position.

9. The combination of claim 8 including said stack of pages, and means to hold the stack of pages in said zone during displacement of said arm.

10. The combination of claim 8 including the actuator in the form of an electrically energized motor coupled to said arm via said actuator driven means to reciprocate the arm between said retracted and advanced positions in response to motor energization.

11. The combination of claim 8 wherein the actuator driven means includes a member linearly reciprocable in said page turning direction and in a return direction, and including a second arm proximate said zone, said actuator driven means having coupling to said second arm for displacing same between advanced and retracted positions, said advanced position characterized in that the second arm overlies the top of a turned page proximate an edge thereof and in spaced relation from said first arm, and said retracted position characterized in that the second arm is out of the path of turning of pages to be turned.

12. The combination of claim 11 including the coupling between the actuator driven means and the second arm, said actuator driven means including a longitudinally reciprocable member proximate one longitudinal edge of a page, said coupling including a link located to extend beneath the pages, the second arm located proximate a laterally opposite, longitudinal edge of said page.

13. In apparatus for sequentially turning pages of a book or the like, the combination comprising (a) structure forming a zone to receive said pages, (b) a turned page holder located proximate said zone to hold down a turned page, and (c) actuator driven means operatively connected with the holder for displacing same between down and up positions, the down position characterized in that the holder is maintained in clamping engagement with an edge portion of a turned page while a page to be turned is being displaced in the turn direction, said up position characterized in that the holder is temporarily raised to allow the turning page to be displaced downwardly onto a previously turned page, after which the holder returns to said down position.

14. The combination of claim 13 wherein the actuator driven means includes a member linearly reciprocable in said page turning direction and in a return direction, said actuator driven means having coupling to said holder for displacing same between said up and down positions.

15. The combination of claim 14 including said coupling which comprises a rocking part connected to said holder to pivot therewith, a spring yieldably urging the holder toward said down position, a pivoted link having releasable coupling to said part, and an operative connection between said link and said member to cause said link to effect pivoting of said part to temporarily displace said holder to said up position in response to reciprocation of said member in said return direction, and thereafter to releasably decouple from said part to allow the holder to snap down to said down position.

16. The combination of claim 15 wherein said releasable coupling includes cam and follower surfaces on the member and link, and including a spring yieldably urging the link in a direction to urge the coupling surface on the link toward the coupling surface on the member.

17. The combination of claim 1 including a retainer yieldably urged toward the edge portion of a page to be turned to retain pages to be turned in a stack during inversion of the pages to face downwardly, while allowing for said displacement of a page to be turned by the pusher.

18. In apparatus for sequentially turning stacked pages of a book or the like, the combination comprising (a) structure forming a zone to receive said pages, (b) actuator driven means carried by said structure, (c) a pusher operatively connected to said means to frictionally push an exposed page in a turn direction and resulting in upward bulging of that page, in response to displacement of said actuator driven means, and (d) a clamping foot located to clamp a page to be turned during initial development of said bulge the foot operatively connected to said means to release said page for turning, in response to displacement of said actuator driven means.

19. The combination of claim 18 includes a first flipper arm operatively connected to said means to move under said bulge and to flip the page over toward already turned pages, in response to displacement of said actuator driven means.

20. The combination of claim 19 including a second flipper arm operatively connected to said means to move under the bulge and to assist in flipping the page over toward already turned pages in response to displacement of the actuator driven means, said arms moving rotatably oppositely during said page turning.

21. The combination of claim 19 including a turned page holder operatively coupled to said means to hold down turned pages during initial displacement of said actuator driven means, and to temporarily move out of the path of a page being turned to allow completion of said turning thereof, after which the holder moves down on the turned page, all in response to said displacement of the actuator driven means.

22. The combination of claim 21 including a hold down string carried by said structure to extend between groups of already turned pages to hold one of said groups in down position.

23. The combination of claim 19 including said book in the form of a paper-back book having a flexible cover.

24. The apparatus of claim 18 wherein said structure includes a book receiving receptacle having a transparent cover.

25. The apparatus of claim 24 including an arm supporting the receptacle for inversion to face downwardly.

26. The apparatus of claim 24 including magnifying means associated with the receptacle and facing said zone.

27. In combination, (a) a book holder defining a book receiving zone;

(b) means including a support arm supporting said holder with said zone facing downwardly, whereby a reclining person may look upwardly to read a book in said zone, and (c) the holder including structure for suspending the book and its pages in position for reading and against dropping and with the exposed pages facing downwardly, and to allow turning of the book pages while the book remains suspended by the holder.

* * * * *